United States Patent [19]

Jones

[11] Patent Number: 4,901,859

[45] Date of Patent: Feb. 20, 1990

[54] CONTAINER

[76] Inventor: David L. Jones, 16 High Street South, Ruskington, Sleaford Linds NG34 9DP, England

[21] Appl. No.: 214,685

[22] Filed: Jul. 1, 1988

[30] Foreign Application Priority Data

Jul. 4, 1987 [GB] United Kingdom ..... 8715775
May 6, 1988 [GB] United Kingdom ..... 8810735

[51] Int. Cl.[4] ..... B65D 21/06
[52] U.S. Cl. ..... 206/506
[58] Field of Search ..... 206/506

[56] References Cited

U.S. PATENT DOCUMENTS 3,169,659 2/1965 Blackmore .
3,421,656 1/1969 Asenbauer .
3,547,309 12/1970 Pusey et al. .
3,586,205 6/1971 Van Daalen .
3,651,977 3/1972 Morgan .
3,909,092 9/1975 Kiernan .
3,944,073 3/1976 Downing .
4,126,265 11/1978 Holmes .

FOREIGN PATENT DOCUMENTS 921843 2/1973 Canada .
2948282 8/1983 Fed. Rep. of Germany .
2110178 10/1971 France .
2296571 12/1974 France .
2325565 9/1975 France .
7905105 6/1979 Netherlands .
1245100 9/1971 United Kingdom .
2008077 5/1979 United Kingdom .
1561225 2/1980 United Kingdom .
1574117 9/1980 United Kingdom .
2129401 5/1984 United Kingdom .
2149757 6/1985 United Kingdom .
2177377 1/1987 United Kingdom .

*Primary Examiner*—George E. Lowrance
*Attorney, Agent, or Firm*—Poms, Smith, Lande & Rose

[57] ABSTRACT

A container comprising a body having a base and a side wall extending upwardly from the base, at least one support member selectively movable between a first position in which a further container can be stacked inside the body, and a second position in which the support member can support the further container above the base, the or each support member being provided with at least one strengthening formation which is adapted to cooperate with a formation in the side wall, and strengthening means provided on the side wall in the vicinity of the or each formation in the side wall.

13 Claims, 4 Drawing Sheets

CONTAINER

BACKGROUND OF THE INVENTION

This invention relates to a container.

More particularly the invention relates to a container having support means selectively movable between a first position in which a further container can be stacked inside the container, and a second position in which the support means can support a further container.

This type of container is described in GB-A-2177377, and comprises a body having a base and a side wall extending upwardly from the base.

The support means comprises at least one support member which has at least one formation which is adapted to cooperate with a respective formation in an upper portion of the side wall.

The container described in this specification is especially suited for use as a receptacle for produce such as fruit and vegetables, including mushrooms. The movable support means enables the containers to be stacked within one another when they are empty, but to be stacked one on top of another, supported by the support means, when they contain produce.

Whilst the container has been found to be extremely effective, there is room for improvement.

When full containers are transported in lorries it has been found that up to about fifteen full containers can be stacked on top of one another.

If more than fifteen containers are used, then some of them tend to become damaged and cannot be reused. The damage can be so severe that the contents of the containers are emptied into the lorry.

However, the interior height of the storage area of most lorries is sufficient to carry between about eighteen and twenty containers; thus, it is usual for part of the storage area to be left unused. This situtation is undesirable because the cost of running lorries is expensive, so the storage space available should be used to the maximum.

It would be advantageous if the containers could be modified to increase the number of full containers which can be transported one on top of another so that none of the storage space in the lorries is wasted.

One way to solve this problem would be to increase the wall thickness of the container. However, this would significantly increase the manufacturing cost of the containers, and would cancel out any saving in transportation costs.

Other forms of container are described in FR-A-2325565 and GB-A-2129401.

SUMMARY OF THE INVENTION

It is an object of the present invention to provide an improved container.

According to the present invention there is provided a container comprising a body having a base and a side wall extending upwardly from the base, and at least one support member selectively movable between a first position in which a further container can be stacked inside the body, and a second position in which the support means can support a further container above the base, the or each support member having at least one first formation which is adapted to cooperate with a respective formation in the side wall, and strengthening means provided on the side wall in the vicinity of the or each formation in the side wall.

The container is especially suited for use as a receptacle for produce such as fruit and vegetables, including mushrooms.

The or each side wall formation is a load receiving formation which enables the load on the or each support means to be transferred directly to the body of the container.

Advantageously the strengthening means comprises at least one strengthening rib extending from the base to the vicinity of the or each side wall formation.

In a particularly advantageous construction two of said strengthening ribs are provided, one on each side of the or each side wall formation. Desirably the two strengthening ribs are equispaced on either side of the or each side wall formation.

In a preferred construction further of said strengthening ribs are provided at intervals along said side wall, and preferably said two strengthening ribs are closer together than the further strengthening ribs. It is desirable that the ratio of the distance between the centres of said further strengthening ribs to the distance between the two ribs on either side of the side wall formation is substantially 1.2:1 to 2:1; more desirably this ratio is in the range of 1.3:1 to 1.5:1, and most desirably this range is substantially 1.4:1.

The or each side wall formation may provide a support for the or each support member. The or each side wall formation preferably comprises a supporting recess disposed in an upper portion of the side wall. The side wall formation is preferably disposed in a rim extending around an upper edge of the side wall.

The or each first formation preferably comprises a projection adapted to be a close fit with the supporting recess.

In a preferred construction two side wall formations are provided for each support member. The first formation may comprise a single projection which extends continuously along the support member, so that when the support member is in the second position the single projection is disposed in both the side wall formations.

The or each first formation may be in the form of a rib having an interior provided with transverse strengthening members, so that the or each first formation serves to rigidify the or each support member.

The or each support member may be provided with a support surface upon which a further container can be supported. A locating projection may be provided on the support surface to assist with the positioning of the further container.

The locating formation may also help to strengthen the support member further. To this end it is preferred that the locating formation comprises a rib having an interior provided with transverse strengthening members. These transverse strengthening members may be similar to the members provided on the first formation.

The or each support member may include detent means cooperating with the side wall in order to secure the or each support member in the support position.

Preferably the detent means comprises at least one locking formation adapted to engage a corresponding locking formation in the side wall. Preferably the detent means comprises two locking formations, and two corresponding side wall locking formations are provided. One side wall locking formation may be arranged on an outer surface of the side wall, and the other side wall locking formation may be arranged on an inner surface of the side wall.

Advantageously, the two locking formations of the detent means are adapted to clamp the sidewall therebetween when the support means is in the second position. This has been found to be particularly useful because it helps to prevent the support means inadvertently being moved out of the second position.

The side wall preferably comprises a first portion, which extends from the base to a ledge, and a second portion which extends upwardly from the ledge. Preferably said two strengthening formations on either side of the side wall formation, more preferably all said strengthening formations, extend along the first portion from the base to the ledge and along at least part of the second portion.

The rim may have a portion extending outwardly of the container from the upwardly extending side wall, and a portion extending downwardly. The side wall locking formation in the outer face of the side wall is preferably formed in the downwardly extending portion of the rim.

Preferably at least said two strengthening formations on each side of the side wall formation extend to a level above the lowermost part of the downwardly extending recess; more preferably all said strengthening formations extend to this level.

Desirably at least one locking formation of the detent means is arranged to be a snap-fit with the corresponding side wall locking formation. This can be achieved by arranging the support means so that the locking formation of the detent means slides over the side wall before reaching the side wall locking formation and is deformed by the side wall during the sliding movement. When the locking formation reaches the side wall locking formation it snaps into engagement therewith. To this end it is preferred that at least part of the support means and the body are made of a resiliently deformable material.

The or each side wall locking formation may conveniently comprise a locking recess provided in the side wall.

A hand grip recess may be provided in the side wall at two opposing sides of the container. The hand grip recesses serve the function of strengthening the side wall and providing a hand grip for lifting the container. The hand grip recesses may also provide a ledge; the ledge may be at the level of the rim to assist in supporting the further container. If the further container is misaligned with the support means, the ledge helps to prevent the further container from falling into the container and crushing the produce therein.

In one embodiment the support means is separate from the body, and is secured in the second position when desired.

However, in the preferred embodiment, the support means is mounted to the side wall, preferably to the rim of the side wall, by a hinge. This enables the support means to pivot between the first position and the second position.

In both embodiments it is preferred that either two or four support members are provided. When four support members are provided, each one may be provided at a respective corner of the container.

The body and the support means may be injection moulded and may be a plastics material. It is preferred that the container is polypropylene.

The further container is preferably a container according to the invention, although it may be any other suitable container.

The length L of the supporting recess along the side wall can be related to the distance $D_1$ between the two strengthening formations and/or to the distance $D_2$ between the strengthening formations and the supporting recess.

It is preferred that the ratio $D_1/L$ is in the range substantially 1.5 to substantially 4 and is most preferably substantially 2.

It is preferred that the ratio $D_2/L$ is in the range substantially 0.2 to substantially 2, and is most preferably substantially 0.5.

In an advantageous construction the support members and side wall are provided with cooperating retaining formations, such that when the cooperating retaining formations are engaged with one another lateral movement of the support member away from the body is substantially prevented.

The cooperating retaining formations may comprise a retaining projection on each support member and a respective retaining recess in the side wall, or preferably a retaining recess in each support member and a respective retaining projection in the side wall.

The retaining formations are such that when the support members are in the second position, the retaining projections are disposed in the retaining recesses.

The arrangement ensures that when the support members are in the second position they are retained on the side wall even if the hinge breaks or if no hinge is provided.

According to another aspect of the invention there is provided a container comprising a body having a base and a side wall extending upwardly from the base, and at least one support member selectively movable between a first position in which a further container can be stacked inside the body, and a second position in which the support member can support a further container above the base, wherein the or each support member includes detent means which cooperates with the side wall in order to secure the or each support member in the second position, and cooperating retaining formations are provided on the side wall and the or each support member such that when the cooperating retaining formations are engaged with one another, lateral movement of the support member away from the body is substantially prevented.

The container according to this aspect of the invention can be provided with any combination of features of the container according to the first aspect of the invention.

BRIEF DESCRIPTION OF THE DRAWINGS

Reference is now made to the accompanying drawings in which.

DESCRIPTION OF THE PREFERRED EMBODIMENTS

Figure 1:
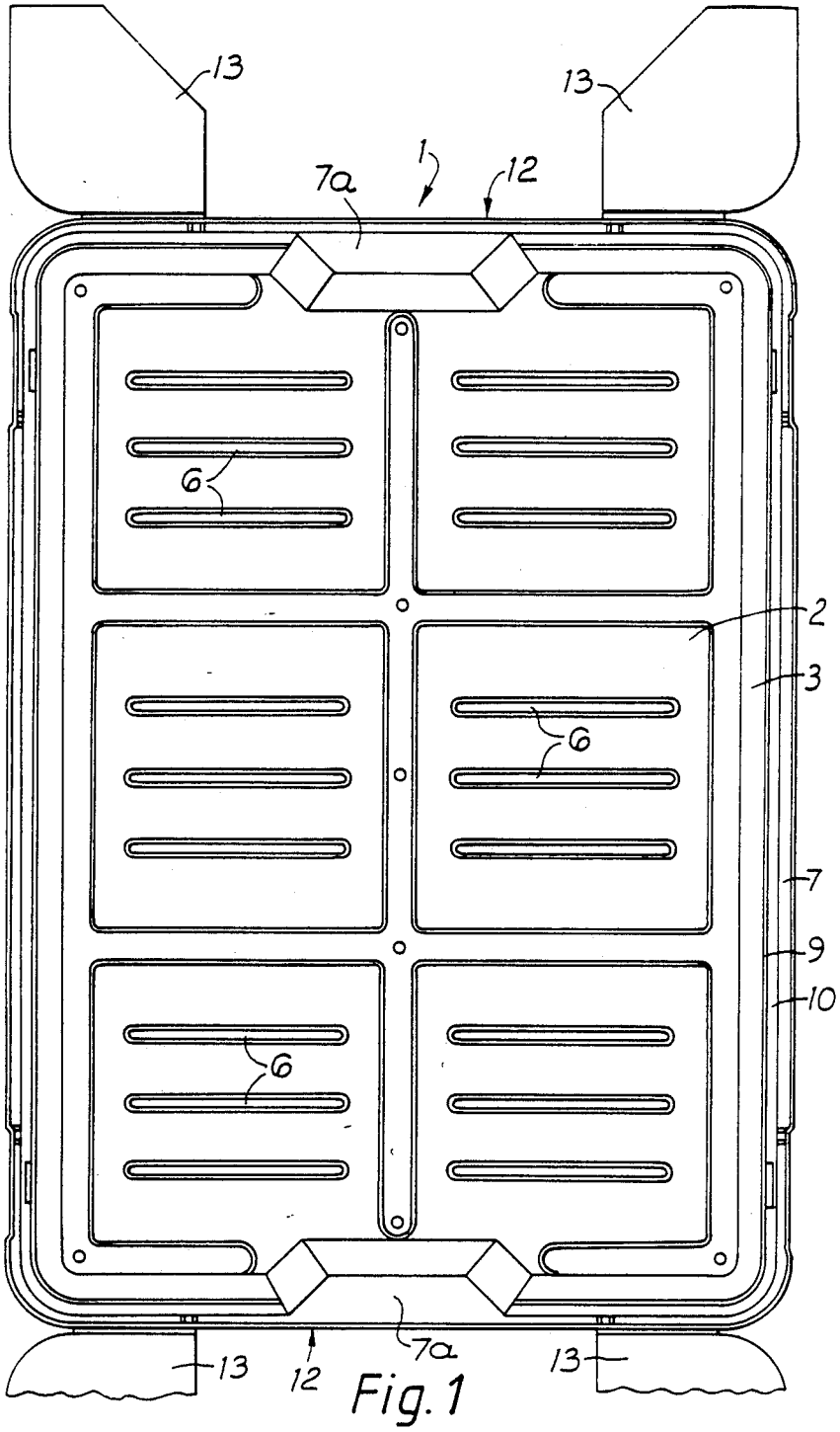
FIG. 1 is a plan view of a container according to the invention.
Figures 2, 3, 4:
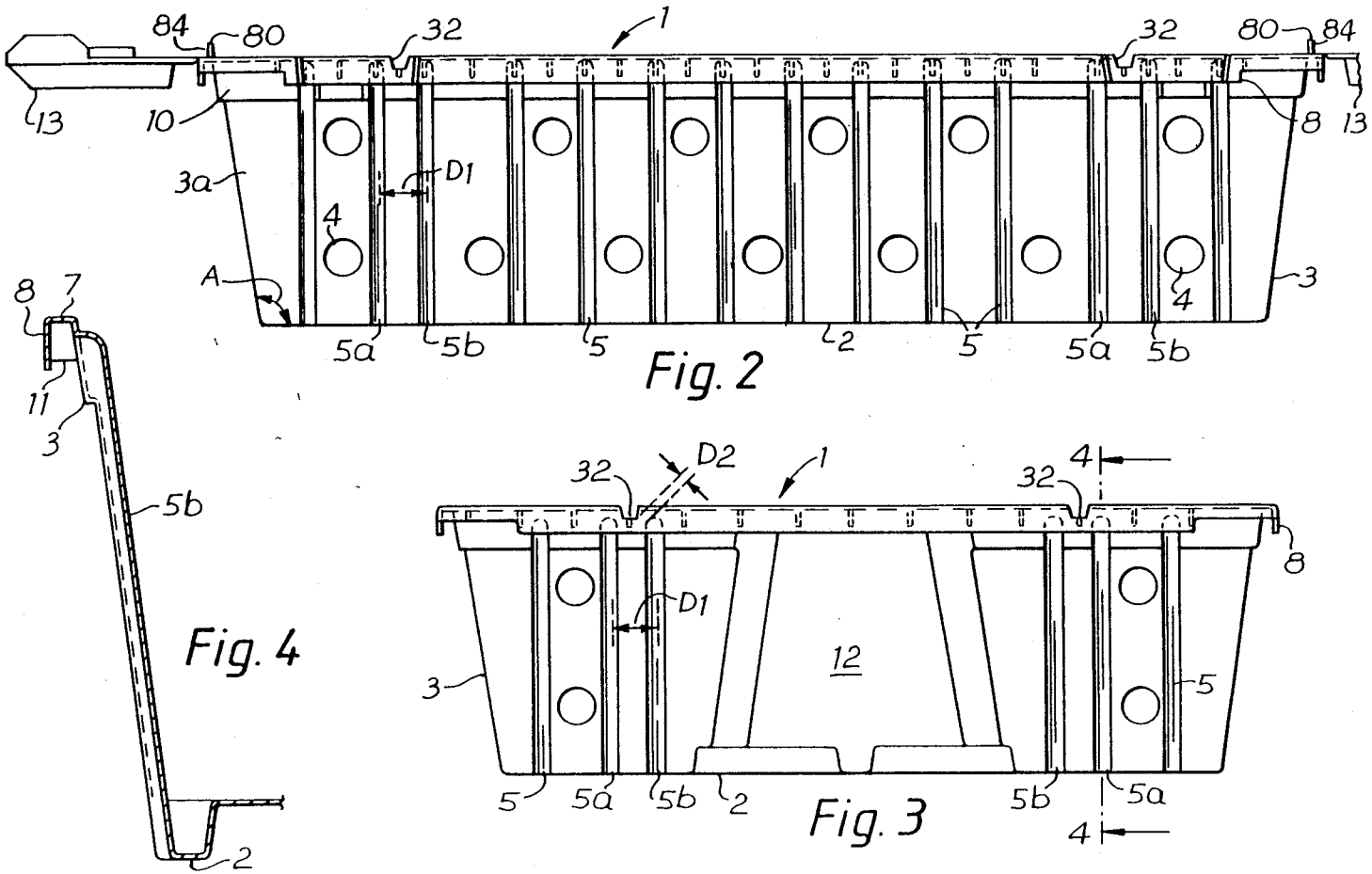
FIG. 2 is side elevation of a container according to the invention.
FIG. 3 is an end view of a container according to the invention.
FIG. 4 is a section on lines 4—4 of FIG. 3.

In FIGS. 1 to 3 a container generally designated 1 comprises a body having a base 2 and an upwardly extending side wall 3. The base 2 and the side wall 3 define a substantially a hexahedral volume which can receive produce such as fruit and vegetables including mushrooms.

The side wall 3 is provided with a plurality of apertures 4, and with strengthening means in the form of a plurality of elongate strengthening ribs 5; in FIG. 1 the ribs 5 are not shown in order to increase the clarity. The base 2 is provided with strengthening ribs 6.

A rim is provided around the top of the side wall 3 which comprises an outwardly extending portion 7 and a downwardly extending portion 8.

The side wall 3 is provided with a first portion 3*a* extending upwardly from the base 2 to a ledge 9, and a second portion 10 extending upwrdly from the ledge 9. The ledge 9 is disposed at a level below the bottom of the downwardly extending portion 8 (see FIG. 4). The second side wall portion 10 extends between the ledge 9 and the outwardly extending portion 7. The portions 7, 8 and 10 are arranged so that they have a substantially U-shaped cross-section. A plurality of ribs 11 extend between the downwardly extending portion 8 and the portion 10 for the purpose of strengthening the rim.

A hand grip recess 12 is provided at opposing sides of the container 1. As shown in FIG. 1, in the region of the hand grip recess 12 the width of the outwardly extending portion 7 is greater than around the rest of the rim to provide a ledge 7*a*. This facilitates gripping the container 1 underneath the rim so that it can be lifted.

The hand grip recess 12 also provides additional strengthening for the container 1, and assists with the support of further containers on top of the container 1.

In the region of the hand grip recess 12, the ribs 11 can be provided on top of the outwardly extending portion 7. To this end the outwardly extention portion 7 may be closer to the base 2 in the region of the hand grip recess 12. This arrangement makes it easier to lift and carry the container 1.

The container 1 is also provided with four support members 13, each one being disposed adjacent an upper corner of the side wall 3. In FIGS. 1 and 2, the support members 13 are not shown in detail, and in FIG. 3 the support members 13 have been omitted for the purpose of clarity.

Figure 5:
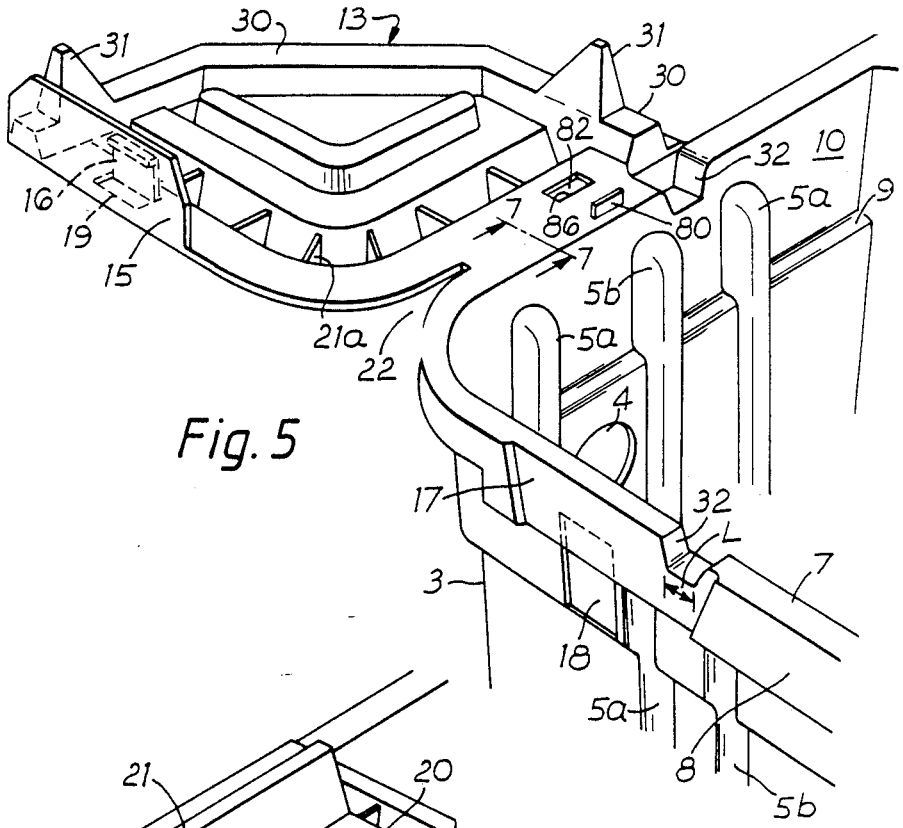
FIG. 5 is a plan view on an enlarged scale of part of a container according to the invention showing support means in the first position.
Figure 6:
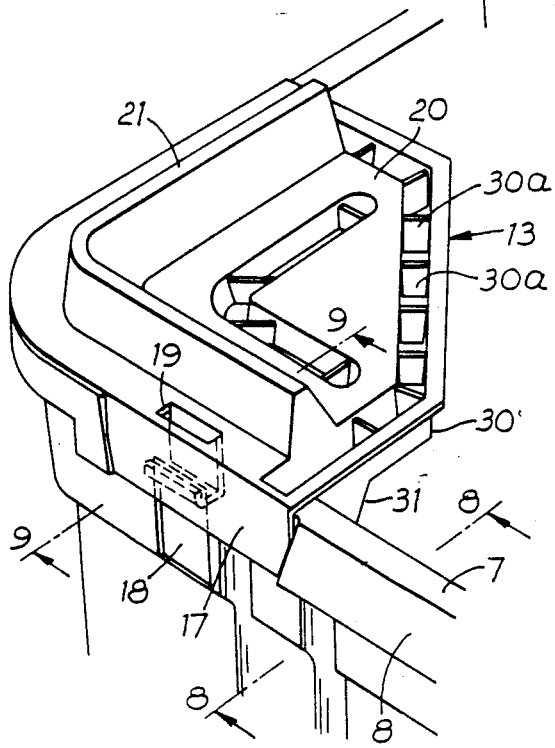
FIG. 6 is a plan view on an enlarged scale of part of a container according to the invention showing support means in the second position.

FIGS. 5 and 6 show the construction of the support members 13 in more detail.

One face of each support member 13 includes detent means in the form of locking formations 15 and 16. The locking formation 15 can fit into a corresponding locking recess 17 provided in the downwardly extending portion 8 of the side wall 3. The locking formation 16 can fit into a corresponding locking recess 18 provided in the second portion 10 of the side wall 3. Four of each of said locking recesses 17 and 18 are provided, one pair of locking recesses for each support member 13.

Figure 9:
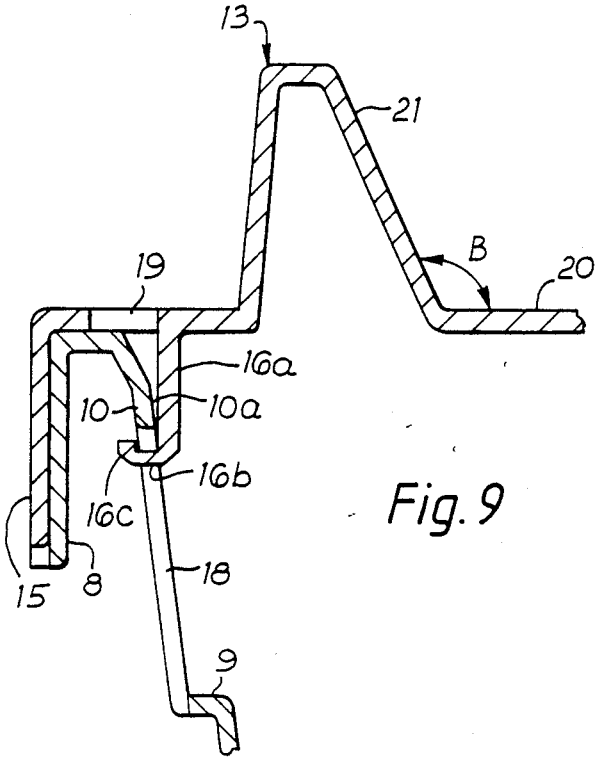
FIG. 9 is a section on lines 9—9 of FIG. 6 on an enlarged scale.

The locking formation 16 includes a first portion 16*a*, a second portion 16*b* and a third portion 16*c*, as shown in FIG. 9. When one of the support members 13 is moved into engagement with the side wall 3, the third portion 16*c* abuts against a surface 10*a* of the second portion 10 and slides over the surface 10*a*. During the sliding movement the first portion 16*a* is deformed inwardly of the container 1. When the portion 16*c* reaches the locking recess 18, the portion 16*a* springs back as far as possible to its original position thus locking the locking formation 16 to the locking recess 18. In this way a snap-fit is provided between the locking formation 16 and the locking recess 18. To this end it is preferable to make the container 1 from a resiliently deformable material such as polypropylene.

Thus, the locking formations 15 and 16 serve to clamp the sidewall therebetween, thereby locking the support members 13 securely to the sidewall 3.

An aperture 19 is provided in the support members 13 between the formation 15 and the formation 16. The aperture 19 is provided to facilitate manufacture by injection moulding.

Figure 8:
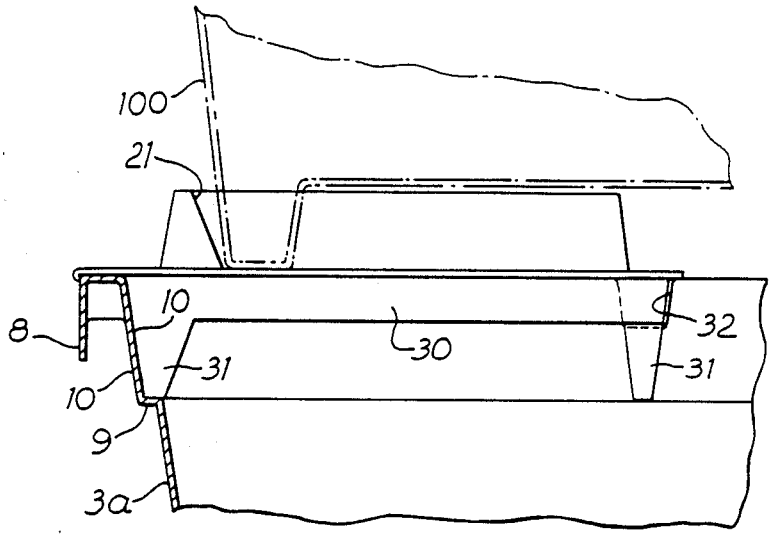
FIG. 8 is a section on lines 8—8 of FIG. 6 on an enlarged scale.

The other face of the support members 13 provides a support surface 20 for supporting a further container 100 (see FIG. 8). The support surface 20 is bounded by a shaped locating formation 21 which in FIG. 9 is shown extending upwardly from the support surface 20 at an obtuse angle B thereto. This arrangement enables the further container 100 to be received on the support surface 20 and in engagement with the formation 21. When the further container is identical to the container 1, the obtuse angle B can be the same as or greater than angle A (see FIGS. 2 and 3) of the side wall 3 to the base 2. The formation 21 is of considerable help with the correct alignment of the further container 100 on the container 1; furthermore, the formation 21 acts as a retaining means to retain the further container 100 in position.

The formation 21 also helps to rigidify the support member 13. To assist with this a plurality of transverse strengthening members 21*a* are disposed in the interior of the formation 21.

Figure 7:
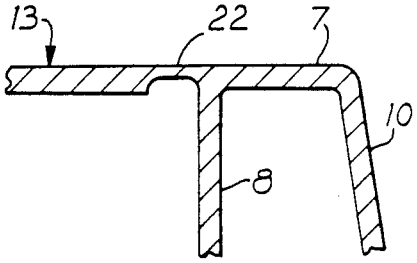
FIG. 7 is a section on lines 7—7 of FIG. 5 on an enlarged scale.

The support members 13 are pivotally connected to the outwardly extending portion 7 of the sidewall 3 by a hinge 22 (as shown in FIG. 7). The hinge 22 enables the support member 13 to pivot about the hinge.

The support members 13 are movable between a first position in which they lie outside the body of the container 1 (as shown in FIGS. 1, 2 and 5) and a second position in which the locking formations 15 and 16 engage the locking recesses 17 and 18 (as shown in FIGS. 6, 8 and 9).

In the first position the containers 1 can be stacked one inside the other, so that a large number of containers can be stored in a small space.

When the containers 1 are filled with produce, for example with mushrooms, then the support members 13 can be pivoted to the second position. This enables the further container 100 to be stacked on the container 1 without crushing the produce contained therein.

The support members 13 include a strengthening formation 30 having two projections 31 extending therefrom. The formation 30 is shaped to be able to sit in two cooperating supporting recesses 32 provided in the rim of the side wall 3. When the support members 13 are in the second position, the strengthening formation 30 sits in the supporting recesses 32, and the projections 31 bear against the portion 10. This arrangement transfers the load of the further container 100 onto the side wall 3 and helps to reduce damage to the support members 13 through stress.

The formations 30 are reinforced by a plurality of transverse strengthening members 30*a* disposed in the interior thereof.

The strengthening ribs 5 all extend substantially vertically from the base into the lower part of the second portion 10 of the side wall 3.

Each of the supporting recesses 32 is provided with two of said strengthening ribs 5 extending into the vicinity thereof. These two strengthening ribs are designated 5*a* and 5*b*. The ribs 5*a* and 5*b* are disposed on either side of each supporting recess 32, and are substantially equispaced from the recess.

In the embodiment shown the distance between the centres of the ribs 5 is about 25 mm, whilst the distance between the centres of the ribs 5*a* and 5*b* is about 18 mm.

The ribs 5*a* and 5*b* serve to transfer the load on the supporting recesses 32 from the support members 13 into the base 2.

The length of the recess 32 is designated L in FIG. 5. The distance $D_1$ between the centres of the ribs 5*a* and 5*b* is equal to about twice the value of L. The distance $D_2$ which indicates the minimum distance between the recesses 32 and the ribs 5*a* and 5*b* is equal to about half the value of L.

In another embodiment (not shown) the support members 13 can be separate from the side wall 3, and are secured to the side wall in the second position when required. In this embodiment the hinge 22 may be replaced by an extra pair of said locking formations 15 and 16 which can engage an extra pair of said corresponding locking recesses 17 and 18. These extra formations and recesses ensure that the support members 13 are firmly secured to the body of the container in the second position.

The container 1 is also provided with cooperating retaining formations in the form of a retaining projection 80 on the outwardly extending portion 7 of the side wall 3, and a retaining recess 82 on the support members 13; for clarity the projection 80 and recess 82 are not shown in FIG. 1. One projection 80 is provided for each recess 82: More than one recess 82 may be provided on each support member 13.

When the support members 13 are in the second position the projections 80 project into the recesses 82. In the second position an outer surface 84 of each projection 80 engages an outer surface 86 of the recess 82 which it projects into. This prevents the support member 13 from moving away from the body in a lateral direction (in the drawings this lateral direction is substantially horizontal and substantially parallel to the base).

The provision of the projections 80 and recesses 82 helps to retain the support members 13 in the second position if the hinge 22 snaps. The projections 80 and recesses 82 serve a similar function in embodiments where the hinge 22 is not provided and the support members 13 are separate from the body of the container 1.

It will be appreciated that the container 1 need not be provided with four support members. For example two support members could be provided instead.

Other modifications are possible within the scope of the following claims.

It will be appreciated that the container 1 need not be provided with four support members. For example two support members could be provided instead.

Other modifications are possible within the scope of the following claims.

I claim:

1. A container comprising a body having a base and a side wall extending upwardly from the base, at least one support member movable selectively between a first position in which a further container can be stacked inside the body, and a second position in which the support member can support a further container above the base, said at least one support member being provided with at least one strengthening formation, and said side wall being provided with a respective load receiving formation for each strengthening formation, each load receiving formation having a support surface and being adapted to receive its respective strengthening formation with said strengthening formation in contact with said support surface whereby loads applied to the at least one support member can be transferred to said respective support surface, and said side wall is provided with strengthening means in the form of at least one strengthening rib which extends along the side wall from the vicinity of a respective one of the side wall formations to the vicinity of the base, whereby loads applied to said support surface can be transferred to the base through said strengthening means.

2. A container according to claim 1, wherein two of said strengthening ribs are provided, said strengthening ribs being disposed on opposite sides of the load receiving formation at substantially equal distances therefrom.

3. A container according to claim 2, wherein the ratio $D_1/L$ is between substantially 1.5 and substantially 4, where L is the length of the load receiving formation extends along the side wall, and $D_1$ is the distance between the two strengthening ribs.

4. A container according to claim 2, wherein the ratio $D_2/L$ is between substantially 0.2 and substantially 2, wherein L is the length the load receiving formation extends along the side wall, and $D_2$ is the distance between the strengthening ribs and the side wall formation.

5. A container according to claim 1, wherein further strengthening ribs are provided at intervals along the side wall.

6. A container according to claim 2, wherein further strengthening ribs are provided at intervals along the side wall.

7. A container according to claim 6, wherein the ratio of the distance between the centres of said further strengthening ribs to the distance between the centres of said two ribs on either side of the load receiving formation is in the range of substantially 1.2:1 to substantially 2:1.

8. A container according to claim 1, wherein the load receiving formation comprises a recess provided in a rim of the side wall.

9. A container according to claim 1, wherein the support member strengthening formation comprises a rib having an interior provided with transverse strengthening members to rigidify said strengthening formation.

10. A container according to claim 1, wherein the or each support member further includes detent means which can cooperate with the side wall to lock the or each side wall to the base.

11. A container according to claim 1, further including cooperating retaining formations on the or each support member and the side wall, so that when the or each support member is in the second position the cooperating formations substantially prevent lateral movement of the or each support member in a direction away from the body.

12. A container according to claim 11, wherein the cooperating retaining formations comprise a recess on the or each support member and a projection on the side wall.

13. A container according to claim 10, further including cooperating retaining formations on the or each support member and the side wall, so that when the or each support member is in the second position the cooperating formations substantially prevent lateral movement of the or each support member in a direction away from the body.

* * * * *